US006371347B1

(12) United States Patent
Gilbertson

(10) Patent No.: US 6,371,347 B1
(45) **Date of Patent: *Apr. 16, 2002**

(54) AIR SWITCH AND PALM GUIDE FOR PAPERMAKING MACHINERY

(76) Inventor: Ronald Melvin Gilbertson, 912 Lawe St., Kaukaurna, WI (US) 54130

( * ) Notice: Subject to any disclaimer, the term of this patent is extended or adjusted under 35 U.S.C. 154(b) by 0 days.

This patent is subject to a terminal disclaimer.

(21) Appl. No.: 09/522,040

(22) Filed: Mar. 9, 2000

Related U.S. Application Data

(60) Provisional application No. 60/123,671, filed on Mar. 9, 1999.

(51) Int. Cl.[7] ..... B65H 26/00; F16K 31/12; F16K 31/00

(52) U.S. Cl. ..... 226/23; 137/485; 137/625.21; 251/355

(58) Field of Search ..... 226/21, 22, 23; 137/625.21, 625.22, 485; 251/25, 355

(56) References Cited

U.S. PATENT DOCUMENTS

| | | | | |
|---|---|---|---|---|
| 2,484,473 A | | 10/1949 | Staege | |
| 2,729,112 A | | 1/1956 | Wendshuh et al. | |
| 2,877,013 A | | 3/1959 | Wendshuh et al. | |
| 3,051,363 A | * | 8/1962 | Brown | 226/23 |
| 3,101,005 A | | 8/1963 | Mittag | |
| 3,750,920 A | * | 8/1973 | Fountain et al. | 226/23 |
| 4,666,073 A | | 5/1987 | DuFour | |
| 4,932,578 A | | 6/1990 | Pajula | |
| 5,664,738 A | * | 9/1997 | Fife | 226/23 X |

OTHER PUBLICATIONS (1) Beloit Corporation, "Beloit Air Guide (Air–Ride Spiring Type)", Operation Manual 1963 (the year of publication is sufficiently earlier than the effective U.S. filing date and any foreign priority date so that the particular month of publication is not in issue), 2 pages.

(2) Beloit Corporation, "Beloit Guide Positioner Or Hand Guide", Operation Manual, 1963 (the year of publication is sufficiently earlier than the effective U.S. filing date and any foreign priority date so that the particular month of publication is not in issue), 2 pages.

(3) Beloit Corporation, "Beloit Auto Guide Palm With Torsion Spring", Product Literature, Dec., 1988, pp. 1–3.

(4) Gilbert & Nash Co., "Gilbert & Nash Air Actuated Oil Dampened System", Lubrication Connection Diagram, Jun., 1995, 2 pages.

* cited by examiner

*Primary Examiner*—Michael R. Mansen

(57) ABSTRACT

An air switch including a housing, a lubrication port, a first air inlet port and an exhaust port is disclosed. The housing includes a chamber. The lubrication port is disposed to deliver lubrication into the chamber. The first air inlet port is disposed to introduce air into the chamber. The exhaust port is disposed to exhaust the lubrication and air from the chamber.

34 Claims, 15 Drawing Sheets

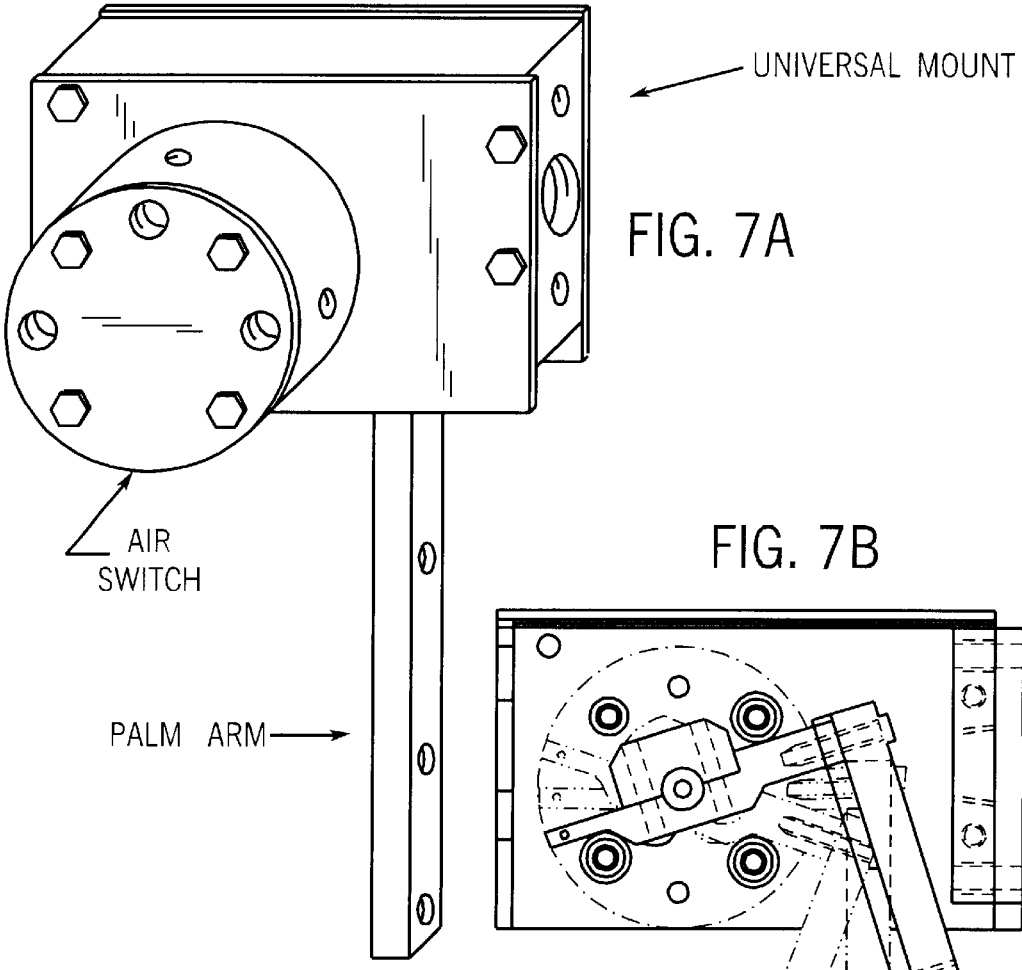
FIG. 7A
FIG. 7B
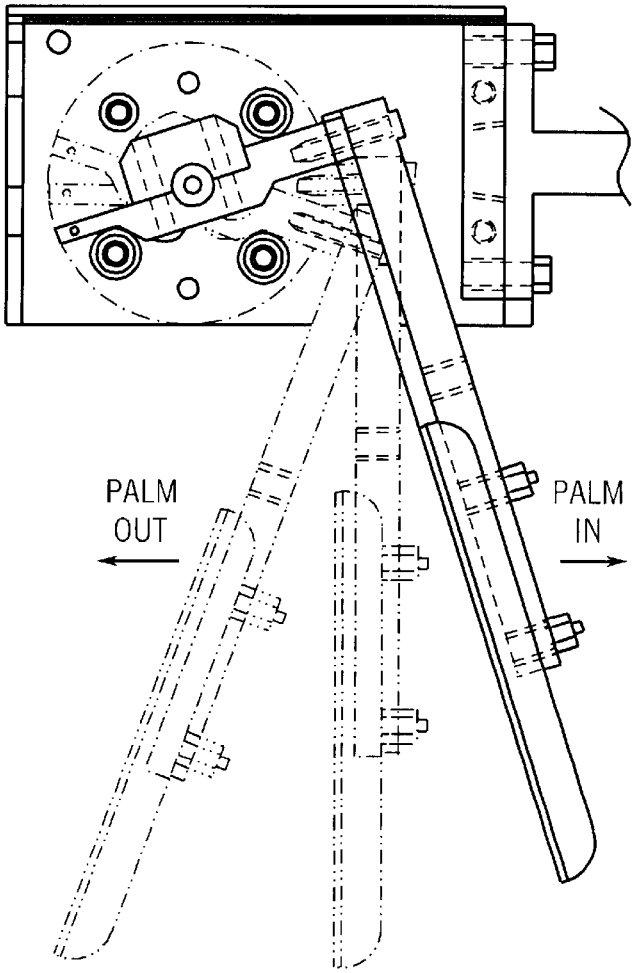
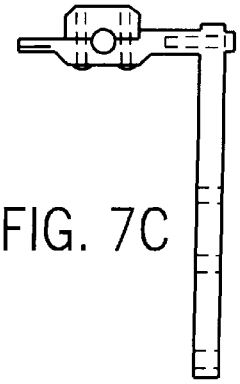
FIG. 7C

FIG. 9A
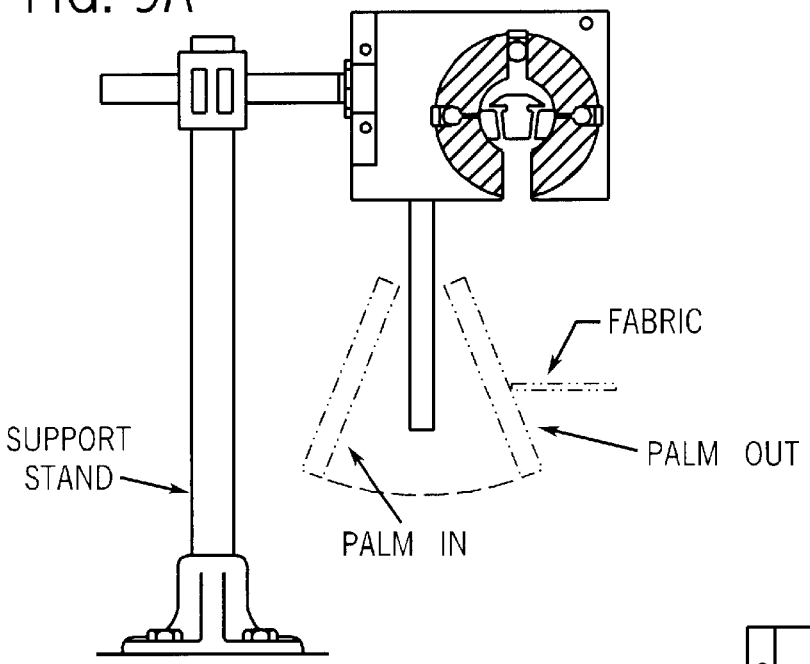
FIG. 9B
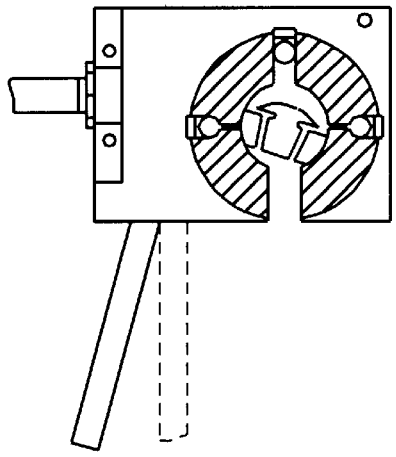
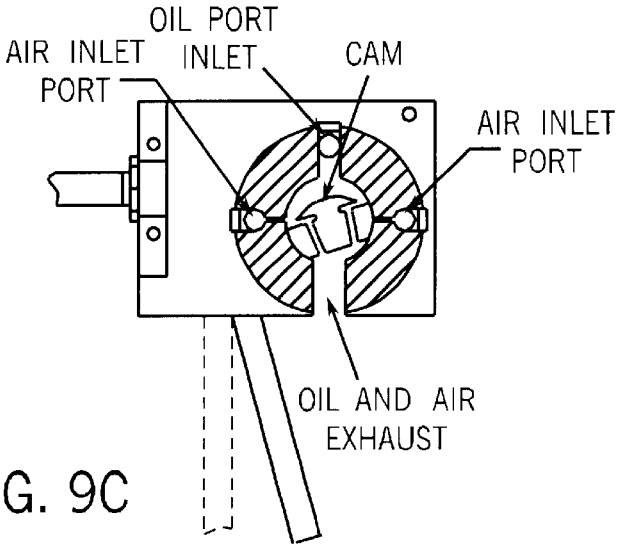
FIG. 9C

FIG. 12A
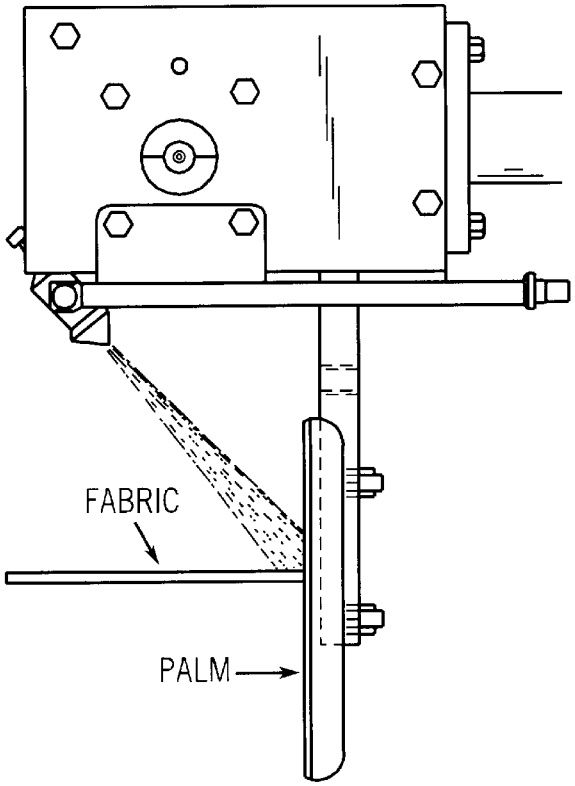
FIG. 12B
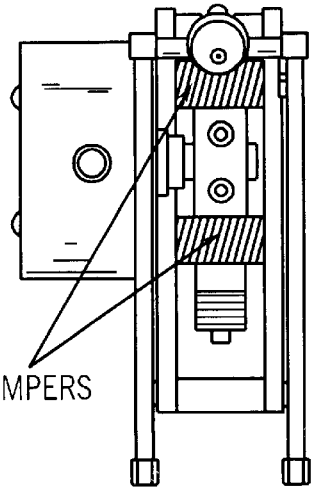
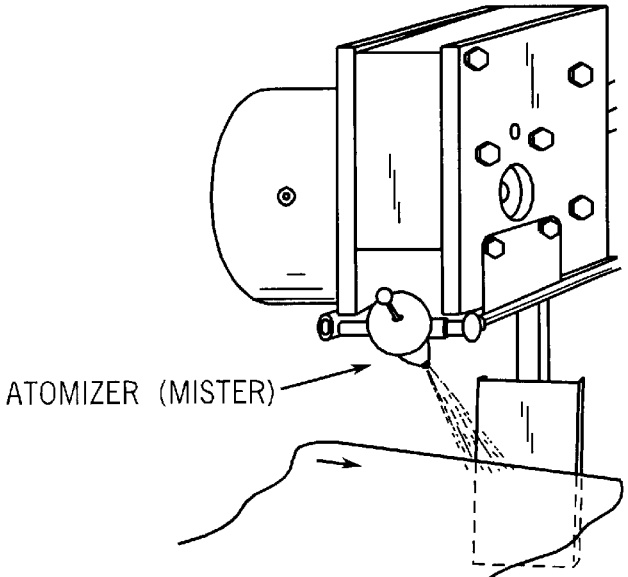
FIG. 12C
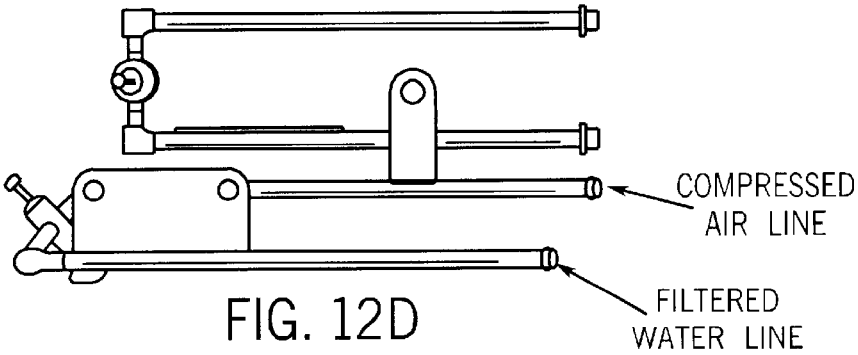
FIG. 12D

AIR SWITCH AND PALM GUIDE FOR PAPERMAKING MACHINERY

CROSS-REFERENCE TO RELATED APPLICATIONS

This application claims the benefit of U.S. Provisional Application No. 60/123,671 which was filed Mar. 9, 1999.

FIELD OF THE INVENTION

The present invention relates to an air switch and palm guide for guiding the high speed fabrics which are used to carry the paper web through papermaking machinery.

BACKGROUND OF THE INVENTION

In the papermaking process, thousands of gallons per minute of liquid pulp or "stock" is poured out of the head box over the forming board and on to the fourdrineer fabric or "wire". At this point, paper is in liquid form, about 98% water and 2% fiber, filler, and chemicals. The fiber is usually made up from virgin ground wood and or recycled paper. The filler is usually clay and/or pulverized calcium carbonate mined from quarries.

A combination of chemicals are added to the water, fiber, and filler to give the paper certain desired properties. This liquid mixture is commonly referred to as the furnish. The mixture or exact recipe of the furnish will vary with different paper grades and types.

A typical wire can be a 140' long loop. The term "wire" predates the invention of plastic type monofilament fourdrineer fabrics. Originally, the fourdrineer fabric was actually made of very fine strands of brass or bronze. The fourdineer or wire table is typically about half as long as the wire, since the wire circumscribes the table in a continuous loop.

The first step of the paper machine, with reference to FIG. 1, is called the formation. Water drains very quickly though the wire after the headbox. Within the first 20 feet of the wire table, much of the water content of the furnish has drained through the wire into the return trays, and the fibers and fillers have formed together in a layer of very wet paper. The last ⅓ of the wire table includes a series of vacuum boxes that sucks more water out of the furnish. A good even formation, with uniformity of the fibers and fillers is important and will result in a stronger, smoother sheet of paper.

At some point near the first or second vacuum box on the wire table, so much water has been drained or sucked away that the layer of furnish loses its watery shine and takes on a dull haze. The particular area on the wire table where shine turns to haze is commonly referred to as the wet line.

The haze that continues down the last part of the wire table is essentially an unpressed wet sheet of formed paper. At the end of the wire table the wet sheet of paper gets sucked off the wire fabric by a pick up roll and transferred onto the pickup wet press felt. The pick up felt is pressing lightly onto the wire fabric. The transfer of the wet sheet is achieved by the vacuum of the pickup roll turning inside of the pickup felt. The pressing section may include multiple presses.

The function of the wet pressing section of the paper machine is to press down the wet fibers and vacuum out more water from the wet sheet. Also, the wet press can to some degree correct or control the profile of the paper sheet with the use of hydraulic profile rolls in the pressing area.

After being pressed, the wet sheet is now transferred to the drying sections, where the wet sheet is carried by dryer felts over and around a series of dryer cans. After traveling over and around many very hot dryer cans, the paper has only 3 to 4 percent moisture or water content. At this point, the dry sheet is wound up at the end of the paper machine as a reel of paper.

A responsive and well-maintained guiding system is very important for efficient papermaking. A smooth, positive guiding system will properly guide the long wire, felt and fabrics in the center of the papermaking machine and will not let them oscillate from side to side.

The fundamentals for guiding any type of paper machine clothing (i.e. wire, felt, fabric, etc.) are basically the same. The felt always travels at right angles to the axis of the guide roll, as shown in FIGS. 2A and 2B. The guide roll generally is pivoted on the backside and movable on the front, and is actuated by a paddle member or palm guide that presses against the felt. This palm senses felt position, and by varying air pressure or mechanical leverage, automatically adjusts the movable side of the guide roll. The felt will move toward the side of the guide roll that it strikes first.

In the process of bumping up speed and efficiency of the paper machine, dryer sections became hooded. Hooded dryers evolved to become completely enclosed dryers. The air temperature inside modern enclosed dryer sections on the. big high speed paper machines can reach well over 300 degrees.

Linked with massive gears and individually weighing many tons, the dryer cans spinning inside the dryer sections are filled with steam temperature of over 400 degrees. Special high temperature monofilament dryer fabrics carry the wet paper over and around the hot dryer cans exceeding 4000 fl/minute. More speed and more heat has caused more problems. Stopping a section of a high speed paper machine can be compared to stopping a fast moving, fully loaded freight train, except the train has a braking system. When a fabric or felt guiding arrangement fails or malfunctions, the fabric or felt can shift its path. Quickly, the felt can run off and into the frame of the machine and become tangled. By the time a section of a huge paper machine can be stopped, the results of any guiding failure or malfunction can be devastating, destructive, and expensive. Guiding failures can be avoided with careful visual observation and routine preventative maintenance. However, the cause of many fabric or felt guiding failure or malfunctions is often the design engineering flaws incorporated into the original auto palm guide.

The auto palm guide is a constantly moving air bleedoff monitoring device controlling the steering action of the fabric or felt guide roll on a paper machine. However, currently available auto palm guides have not evolved enough to meet the demands of the modern high speed paper machine. The high speed paper machine is now in an environment of dust and dirt, 300 degree plus heat, and high moisture. This environment is the enemy of sealed bearings and unlubricated parts in constant movement, such as in the known auto palm guides.

Currently, two types of guiding arrangements are in use on high speed, fine paper machines. One commonly used auto palm guide is a single bleedoff type which utilizes a tapered metal plunger as a bleedoff monitor, usually with a single rubber diaphragm actuating the guiding arrangement. The single bleedoff type of auto palm guide is commonly considered disposable. The use of this tapered plunger device dates back to the early 1950's and is still used as original equipment on machines made in the 1990's. This design has many unlubricated parts and an average life expectancy of about two to six years.

An original single bleedoff tapered plunger type auto palm guide, shown for example in FIG. 3, is a simple device. This type of guide is relatively problem free, except for the metal plunger getting dirty and sticking at the "palm in" position or the return spring breaking. The tapered plunger guide is considered disposable. The see-saw action of the plunger wears the round tapered hole of the plunger into an oval. The elongated hole will progressively leak more air.

After much use, the worn guide device can no longer build sufficient pressure in the guide diaphragm to push the guide roll out. Also at this point, the hole located at the top of the cast aluminum palm arm that connects the palm arm to the plunger will be worn excessively as will the palm arm pivotal bushings.

The second commonly used type of original equipment auto palm guide is a double bleedoff type, shown for example in FIGS. 4A–4D. The double bleedoff type is used with a twin bleedoff line diaphragm or a positioning cylinder type guiding arrangement. This type of auto palm guide is inherently more complicated, consisting of many more unlubricated moving parts. These parts include triple springs, twin ball and seats, adjustment pins, etc. Although double bleedoff type of devices are considered to be rebuildable, these units require frequent maintenance, and are unpredictable. With reference to FIG. 4, the reference numbers indicate the following components and parts: 1—air exhaust out; 2—stand; 3—fabric; 4—two air bleedoff inlets; 5—two fine springs; 6—rocker arm; 7—two O-ring seats; 8—two balls; 9—two palm arm bumpers; 10—two rocker arm adjustment pins; 11—air exhaust escape passage; 12—eye bolt; 13—palm arm; 14—main shaft; 15—two sealed bearings; and 16—palm arm return spring.

During a monthly maintenance shutdown, when the paper machine is stopped, it is not unusual to change out at least 4 of the 16 auto palm guides because they are not operating properly. Additionally, two common human errors can occur during installation. First, if the adjustable pins on the rocker cam are not set correctly after a rebuild, the double bleedoff guide will have either no free play or too much free play, causing oscillating or the loss of the fabric being guided.

Second, if the set screws on the pressure reducing (flow control) valve are not adjusted correctly, too little air flow will result in the positioning cylinder stalling in one direction. Alternatively, too much air flow stalls the palm arm in the center of its travel, because the palm arm return spring doesn't have enough torque to push the balls out of their seats and lift the palm out. The difference between too little and too much air is about one sixteenth of a turn. If the positioning cylinder or the palm arm stalls, the fabric being guided can be ruined.

Admittedly, some human errors have been made in learning the quarks of the double bleedoff type guiding arrangement. For example, it would seem natural to turn the set screws on the pressure reducing (flow control) valve a quarter turn open to get more responsive action from the positioning cylinder. However, this is the most common mistake made by a novice. If too much air is provided, the palm guide will cease to operate and stall at any time without warning, resulting in a damaged fabric.

The following is a list of ten design flaws in the known double bleedoff guides that cause difficulties.

1) Eventually the O-rings on the pressure reducing (flow control) valve dry up and leak air. This results in sluggish guiding.

2) In time, the rubber strip palm arm bumper dries up and crumbles off. The palm arm then can travel so far that the rocker cam adjustment pin smashes into the balls seat and bends the pin. This wrecks the seat, causing guide failure or malfunction.

3) Often the palm arm return spring breaks from a stress fracture due to metal fatigue which results in guide failure.

4) Occasionally the area where the palm arm return spring is located accumulates enough moisture to rust the spring to pieces, resulting in guide failure 5) Occasionally the eye bolt on the palm arm return spring wears excessively. When this occurs two things can happen. Either the palm arm return spring loses some of its tension and can't lift the paddle out, or the eye of the eye bolt gets so thin that the eye bolt breaks at the eye, both scenarios result in guide failure.

6) Often the fine springs that hold the balls in the seats wear thin and crack in half from rubbing on the walls of the air passages. With little or no spring pressure holding the ball in the seat, air pressure will not build and the positioning cylinder will stall. The result is guiding failure.

7) Often the (ball & seat) balls become egg-shaped or deformed from the normal operation of metal to metal contact of rocker arm adjustment pins pushing into to the balls. The balls then won't seat which causes blow bye and oscillation of the fabric being guided.

8) Often rocker arm adjustment pins mushroom at the tips where they come in contact with the balls. This damage will shorten the life of the bails and seats, and also increase free play of the palm arm.

9) Often the O-ring seats dry up and shrink, causing blow bye, uneven pressure, and oscillation of the fabric being guided.

10) Very often the two small sealed roller bearings get wet, rust, seize up, or drag. Or their grease dries up and gets hard. Even high temperature bearings often fail. The roller bearings rotate the shaft to which the palm arm, palm arm return spring and rocker arm are fastened.

Also, the original equipment auto palm guides are primarily made of brass. Brass is an unstable metal for longevity in a paper machine environment with a 300 degree heat range. The expansion and contraction differential for brass is considerable. Also mixing dissimilar metals in a unit where close tolerances are required is not wise as the metals do not expand or contract together in parallel graduations.

SUMMARY

The air switch and palm guide of the present invention is carefully and thoughtfully designed to bolt to or screw on most original auto palm guide supports. The air switch is engineered to mimic calibrated air bleedoff characteristics identical to that of the original equipment palm guide. The unique design of the radial air switch and palm guide allows it to work in conjunction with both single and double bleedoff style guiding arrangements. The radial air switch and palm guide of the present invention is made of all stainless steel except for the bearings, camshaft seal, Viton O-rings, and high temperature silicone palm arm bumpers. The palm arm is constructed of 2024 aircraft aluminum to reduce inertia for smoother and more constant contact to the fabric or felt. The only parts that can wear are the two inexpensive heavy duty roller bearings and the cam seal which are immersed in a constant flow of fresh oil and air.

BRIEF DESCRIPTION OF THE DRAWINGS

FIG. 7A shows a partially assembled guide unit according to the invention including an air switch, universal mount and palm arm.

FIG. 7B shows a cross-section of the unit in FIG. 7A and the portion of the new palm arm and clamp assembly.

FIG. 7C shows an assembled palm arm.

FIG. 9A is a schematic of a cam according to the invention in a neutral position and shows the radial air switch and radial cam rotation.

FIG. 9B is a schematic of a cam according to the invention in a palm-in position.

FIG. 9C is a schematic of a cam according to the invention in a palm-out position.

FIG. 12A shows a side view of the high temperature edge preserver lubrication device in operation.

FIG. 12B shows a bottom view of the edge preserver unit.

FIG. 12C shows a perspective view of an edge preserver unit.

FIG. 12D shows fluid delivery hoses and pipes associated with the edge preserver unit.

DESCRIPTION OF THE INVENTION

Figure 1A:
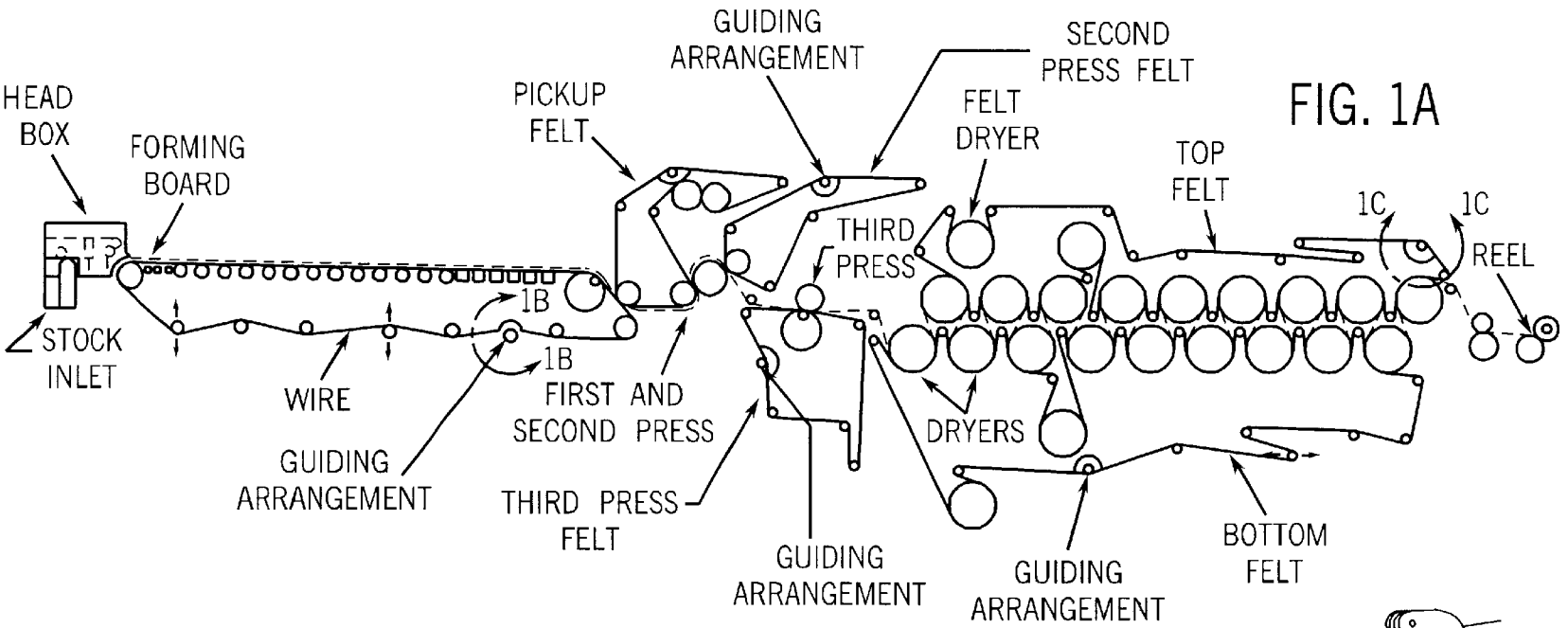
FIG. 1A shows a side schematic of a typical paper making machine layout having 6 fabrics including 1 forming fabric, 3 wet press fabrics and 2 (top and bottom) dryer fabrics, with each fabric having a guiding arrangement.
Figure 1C:
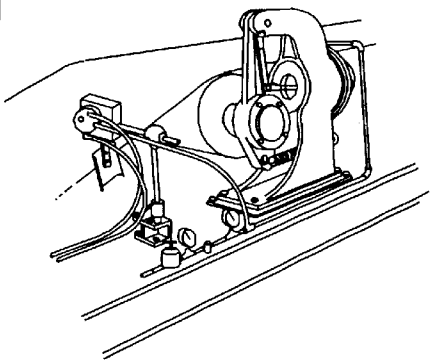
FIG. 1C is a perspective view of a guide arrangement incorporating the present invention.
Figure 1B:
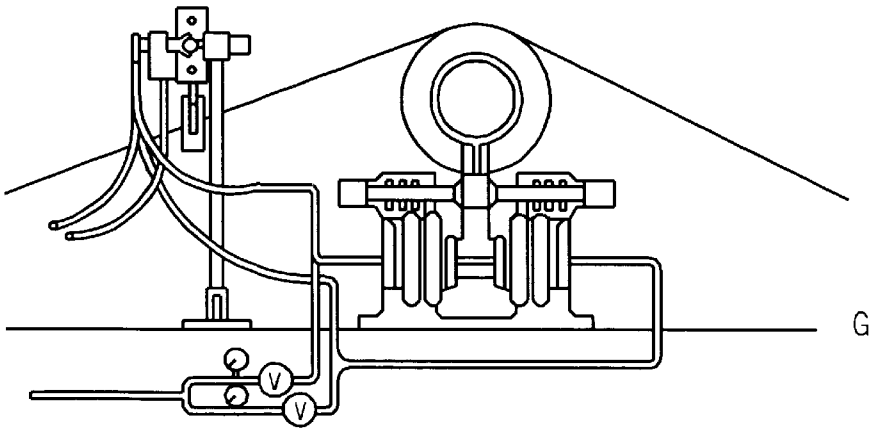
FIG. 1B is a side view of a guide arrangement incorporating the present invention.

With reference to the problems associated with the current known single and double bleedoff type auto palm guides currently in use, a radial air switch, on the other hand, is desirable. The radial air switch is more reliable because it has no frictional contacts, such as in the tapered piston and twin ball and seat air switches currently in use. The correct geometrical layout and size for the air port openings and inside cylinder diameter have been determined. A new radial cam has been developed with specific configurations, including critical rotational timing parameters indexed by degree. These parameters precisely mimic the air bleed flow rates through the spectrum of the "palm in and palm out" travel of the original single and double bleedoff types of existing auto palm guides. Thus, the new radial air switch of the present invention can easily replace existing air switches and interface with most big, high speed paper machines having pneumatic type guiding arrangements.

During development of an initial embodiment of the new, heavy duty stainless steel radial air switch, it was discovered that the radial cam was difficult to rotate. The seals on the large 1⅝" OD bearings created too much drag on the rotation of the cam. When the seals were removed, the cam rotated freely. But without seals, the open roller bearings would have to be lubricated.

One solution for lubricating the air switches was air oilers. Air oilers mix oil with the air that passes through them like a spray gun in order to lubricate moving parts in pneumatic motors, air tools, etc. Low air pressure applications require air oilers to be mounted approximately fifteen inches away from unit to be lubricated. However, oil kept in an environment of over 175 degrees will quickly become rancid and ineffective as a lubricant. Also air oilers need a greater volume of air than the radial air switch of the present invention use. Even low air pressure, high efficiency air oilers with the lightest weight, special air oiler oil would not function properly, if at all.

Another source of lubrication would be small oil reserve containers. Flow control valves with sight glasses would be mounted above the auto air guides. But small reservoirs would depend on someone filling them regularly and the thought of someone possibly getting in contact with 200 degree oil was not acceptable.

All bearings on the paper machine have an oil in and an oil out line. The oil in or feed at the top of the bearings comes from a gravity flow reserve tank above the paper machine, or is pumped directly from a reserve tank. The oil return line at the bottom of the bearing is piped down to a larger return line which has elevated breather caps. The used oil flows back to the reserve tank to be filtered and recirculated, thus providing a source of lubrication. See FIG. 11 for a typical oil piping system.

The air switch and palm guide of the present invention can take a constant full flow of oil and run it through the radial air switch cam chamber. Instead of exhausting the oil into the atmosphere, the oil is piped from the air switch directly into the oil return line of the paper machine along with the used bleedoff air. The used air will escape out the breather caps of the return lines, and the used oil will flow back to the paper machine oil reserve tanks. The oil can't get into the guiding piping, because the cam chamber has no pressure, but the air bleedoff lines do. In addition, the radial air switch and palm guide oil feed pipe is ⅛", and the oil and air exhaust is ¼" pipe, so oil will not back up. See FIG. 6B, for example.

The oiling efficiency of the new air switch is further increased by the configuration of the new cam. With reference to FIGS. 8A and 9E–G, two bleedoff air flow pressure escape passages are drilled half the way through the cam body to the center of the cam to intersect two holes drilled from the bottom of the cam, angled towards the exhaust exit. When the air switch cam rotates to open an air inlet port, oil is actually sucked into the oil entrance port on top of the air switch, in the same manner that a carburetor sucks down air. The turbulence of the bleedoff air and oil rushing through the escape passage atomizes some of the incoming oil and creates a fog that circulates inside of the cam chamber and out the exhaust exit. Furthermore, the new cam is cut flat on top so that when it rotates to open either air inlet port, the flat top of the cam tilts so as to direct the incoming flow of oil toward the opening air inlet port. The entire lubrication process is thus becomes an integrated lubrication system.

Two approximately six by four inch stainless steel plates are spaced one and one quarter inches apart and are used to mount the radial air switch cylinder on either side of the mounting stand. A stainless steel spacer block is used as a universal mount which will allow the auto palm guide to be bolted or screwed onto many different original equipment stands.

Also, a new palm arm shaped like a number "7" is clamped to the shaft of the radial air switch and hung like a crowbar would hang from the crowbar teeth. The configuration of the new arm allows the palm guide to return to a neutral position and therefore doesn't need a breakable, and therefore undesirable, return spring. See FIGS. 7A–C.

The palm guide of the present invention includes three individual assemblies, the radial air switch, the mounting bracket, and the palm arm apparatus.

The radial air switch includes a heavy circular stainless steel cylinder with a 3½" OD and a 1⅝" ID. The cylinder houses a stainless steel cam rotating on two open roller 1⅝" od ¾" id press fit bearings. The cylinder is sealed on one end by a stainless 3½" flat circular cover fastened with four bolts and sealed with an O-ring. At the other end of the air switch cylinder, the camshaft protrudes out about 1½". When the air switch cylinder is bolted to the mounting bracket, the protruding camshaft provides a shaft for the palm arm to be clamped to in a cantilevered manner. The cylinder has four holes drilled and tapped in relation to the four holes drilled into the mounting plates for mounting purposes. The air switch with the O-ring can be mounted to either the right or left plate by pressing in the cam seal on the desired side.

Figure 10A:
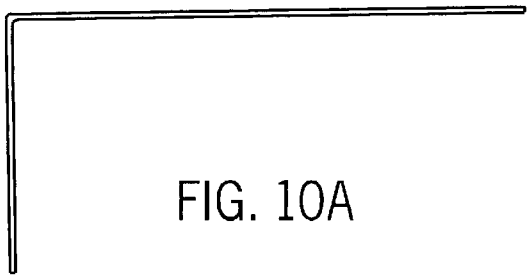
FIGS. 10A–U show a layout of most of the component parts of the radial air switch and palm guide assembly.
Figure 10E:
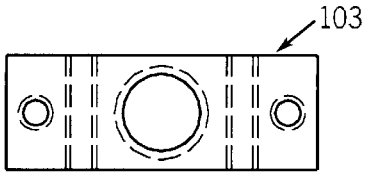
Figure 10F:
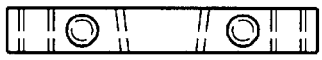
Figure 10B:
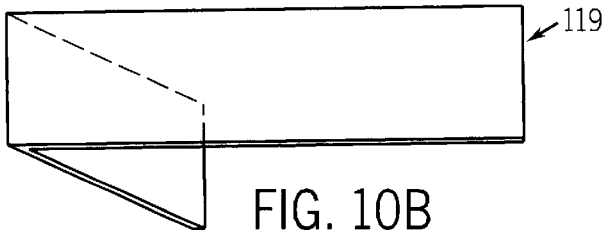
Figure 10C:
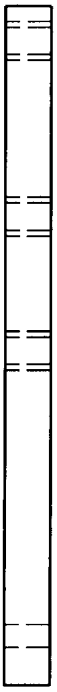
Figure 10D:
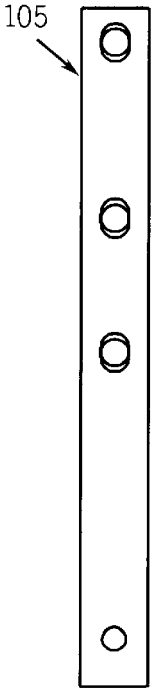
Figure 10G:
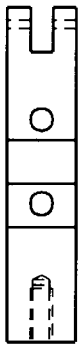
Figure 10H:
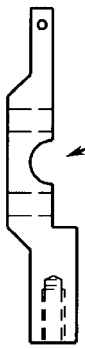
Figure 10J:
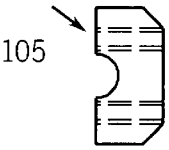
Figure 10L:
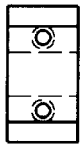
Figure 10K:
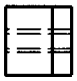
Figure 10I:
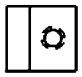
Figures 10M, 10N:
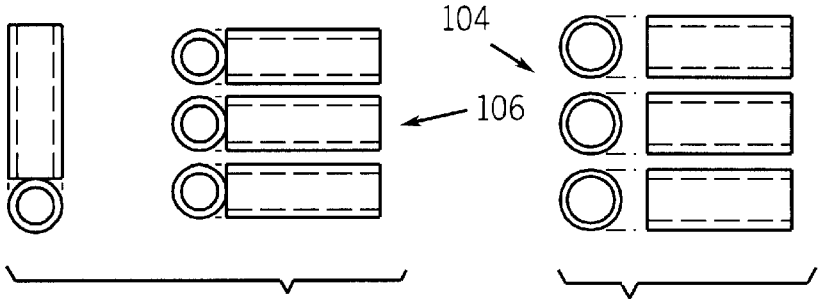
Figure 10O:
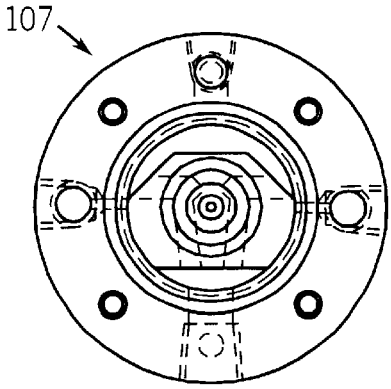
Figures 10P, 10Q:
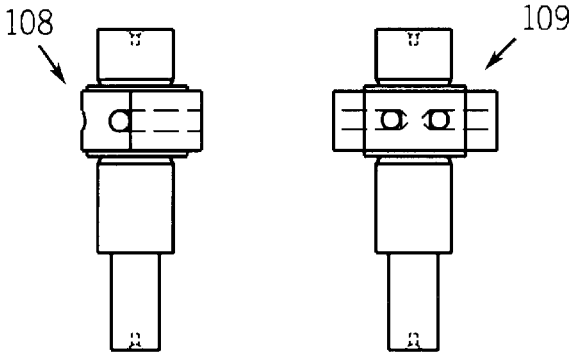
Figure 10R:
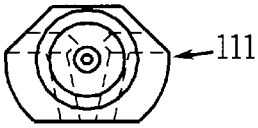
Figure 10S:
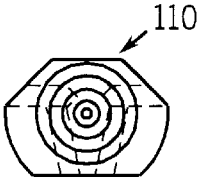
Figure 10T:
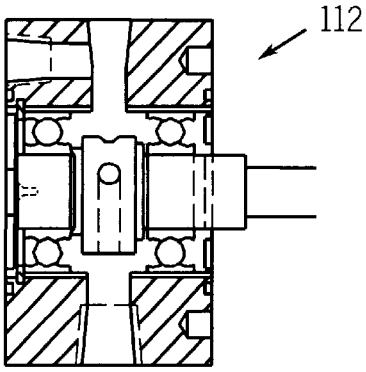
Figure 10U:
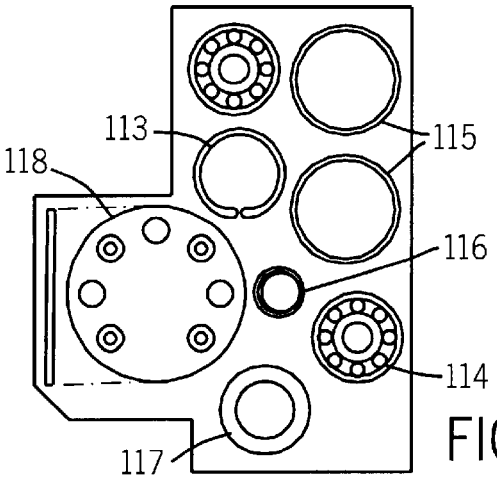

With reference to FIGS. 10A–U, the various parts of the radial air switch and palm guide of the present invention are shown. The reference numbers indicate the following: 103—universal mounting block spacer; 104—three 1¼ inch silicone ½ id bumpers; 105—palm arm and clamp assembly dissembled; 106—four 1½ M inch by ½ inch od spacers; 107—radial cam installed in radial air switch cylinder at 0 degrees; 108—side view of radial cam and camshaft; 109—bottom view of cam and camshaft; 110—cam palm arm end view; 111—cam end view; 112—side cross-section of cam installed on bearings in radial air switch; 113—internal snap ring; 114—two 1⅝ inch open roller bearings; 115—two O rings; 116—camshaft lip seal; 117—spacer ring; 118—air switch cover; 119—L-shaped mounting bracket cover.

The mounting bracket includes two stainless 6¼" by 4" by ¼" plates machined as mirror opposites of each other. The plates are positioned 1¼" apart with the four hollow stainless spacers and the L-shaped stainless cover. The spacers and cover are counter sunk ⅛" into the inside of both plates. Also the 3⅜" by 1¼" by ¾" stainless mounting block is located between and flush with the plates at the rear.

The palm arm is made of 2024 T351 aircraft aluminum. The arm is shown in FIGS. 7B and C. The new arm is shaped like a number "7" with a integral compression clamp used to fasten it to camshaft of the radial air switch. The plate of the palm guide is fastened onto the lower end of the "7" shaped arm. The clamp is located about halfway across the top of the "7" shaped arm, 2" to the left of the lower longer part of the arm. When the palm and arm are clamped to the cam shaft inside the mounting bracket, the cam becomes a pivotal axis. A much greater amount of weight is suspended to the right of the axis so gravity will push the palm in an arc down and out eliminating the need for a breakable return spring.

Operation of the Radial Air Switch

FIG. 1A illustrates a typical layout of an older paper machine with a probable vintage of 1920's to 1940's. The majority of paper machines made back as far as the 1920's are still in use. These older machines usually run specialty grades of paper and remain profitable to operate and may require 6 or more guiding arrangements.

A typical 90's vintage paper machine can have as many as 17 guiding arrangements. These newer paper machines utilize twin wires or forming fabrics, 4 wet press felts, and as many as 6 top and 5 bottom dryer fabrics.

Figure 2A:
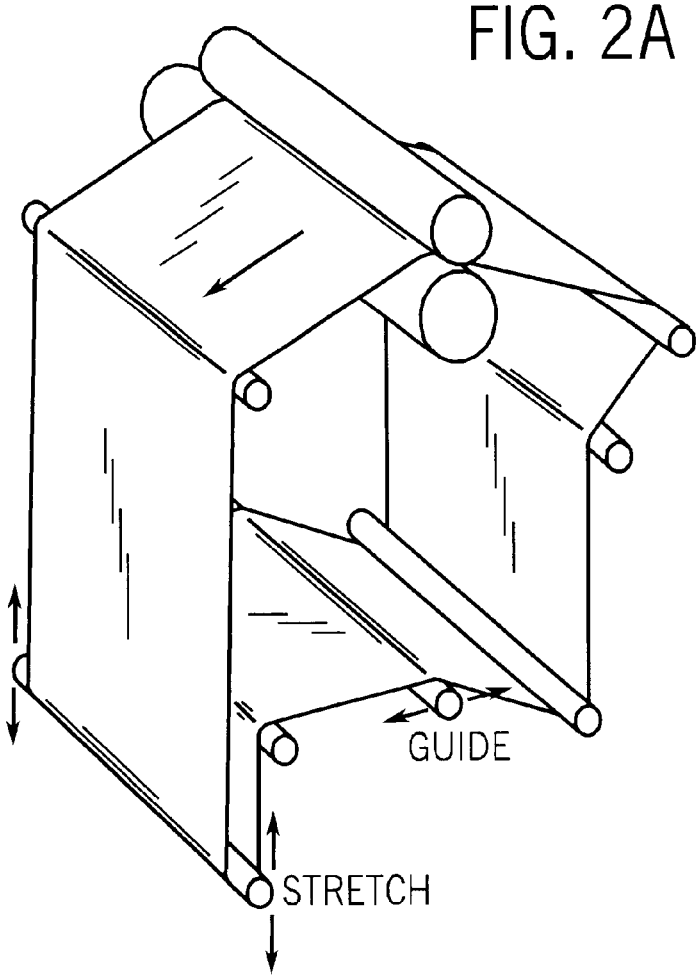
FIG. 2A is a schematic view of a typical felt run with press, guide and stretch rolls.
Figure 2B:
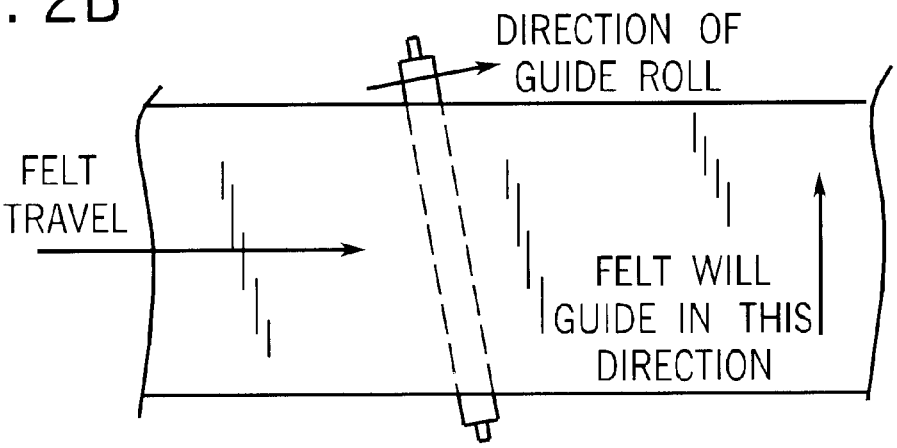
FIG. 2B shows how a felt roll centers the felt in response to a guide signal.
Figure 3:
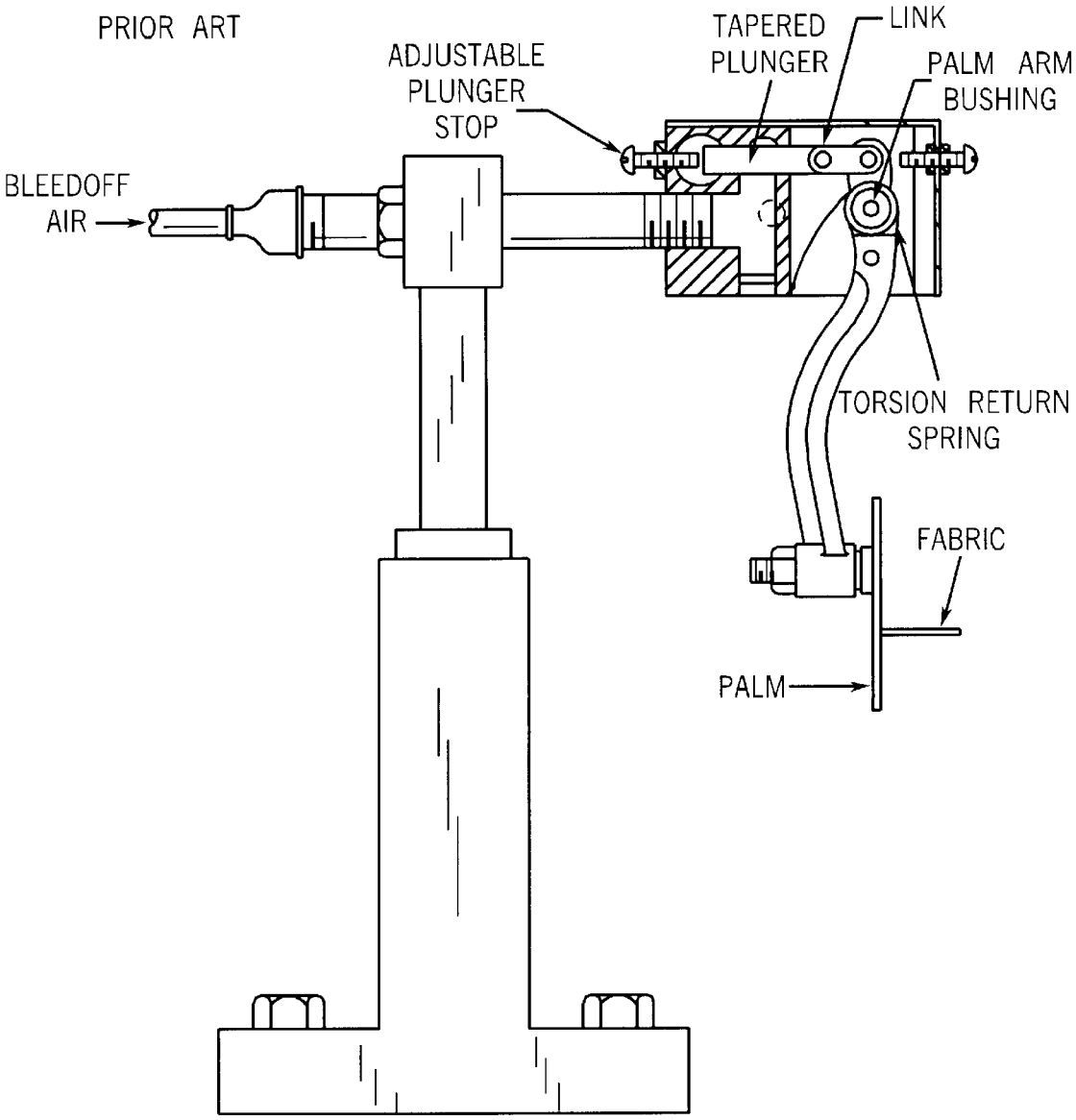
FIG. 3 PRIOR ART
FIG. 3 shows a cross-sectional view of a single bleedoff plunger type auto palm guide of the prior art.
Figure 4B:
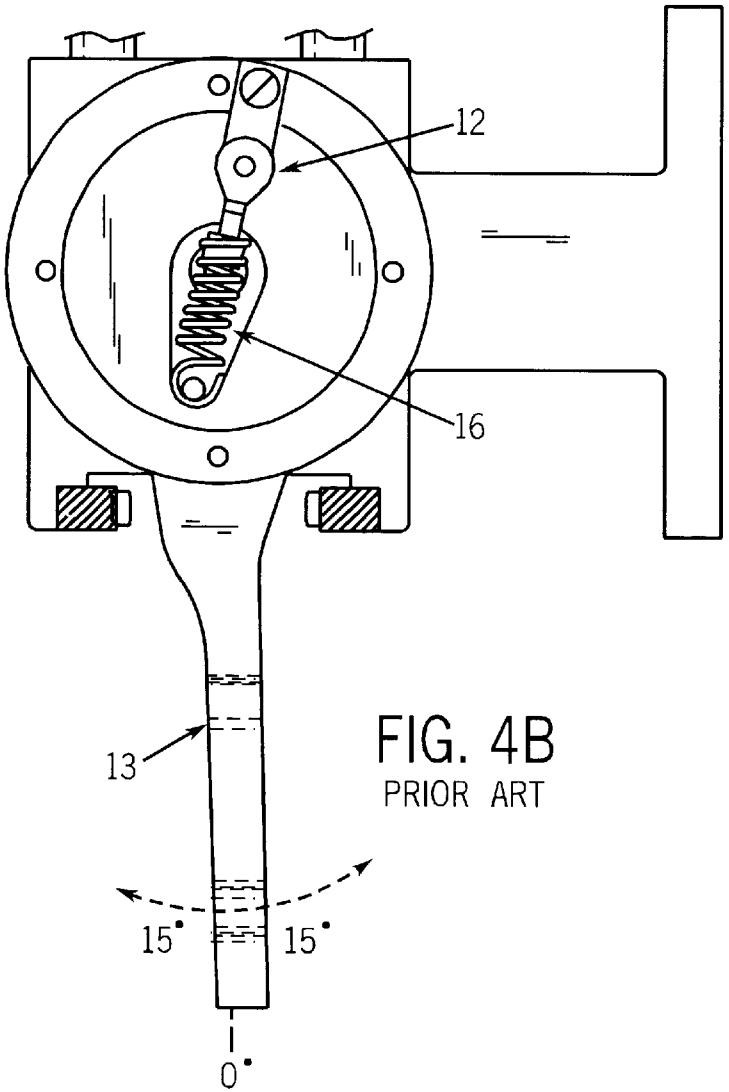
FIG. 4B PRIOR ART
FIG. 4B shows a cross-sectional view from the opposite side of a double bleedoff auto palm guide of the prior art.
Figure 4A:
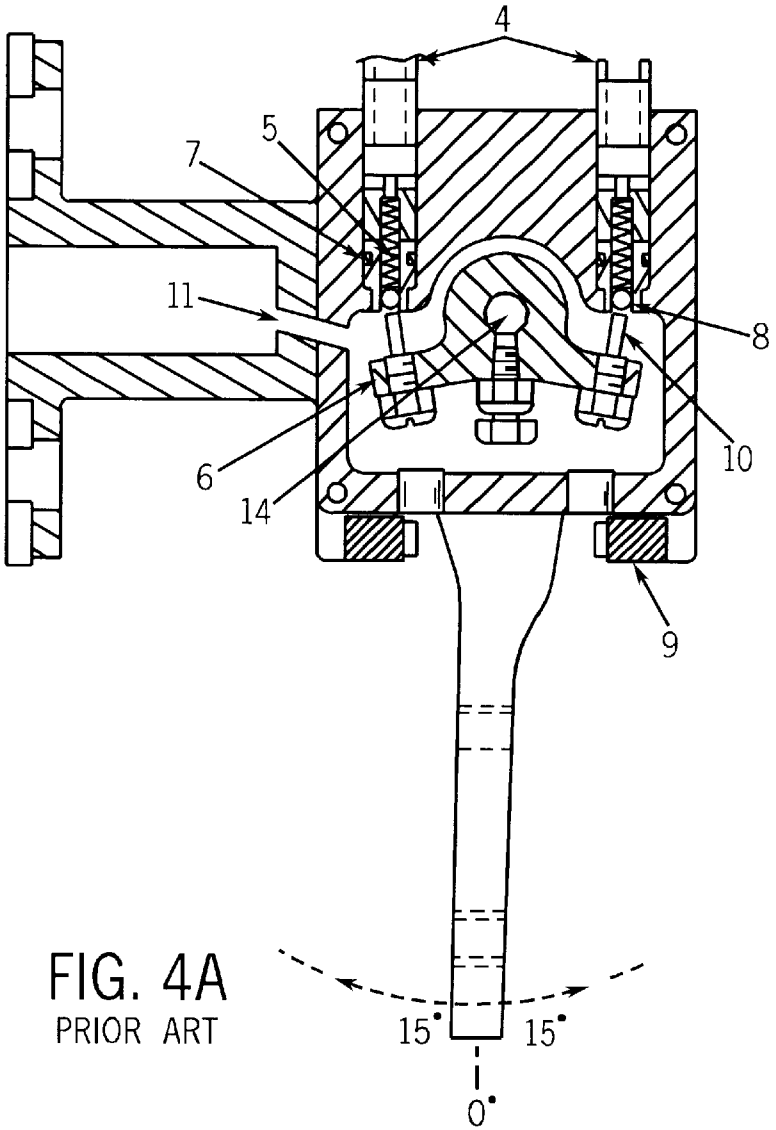
FIG. 4A PRIOR ART
FIG. 4A shows a cross-sectional view of a double bleedoff auto palm guide of the prior art.
Figure 4C:
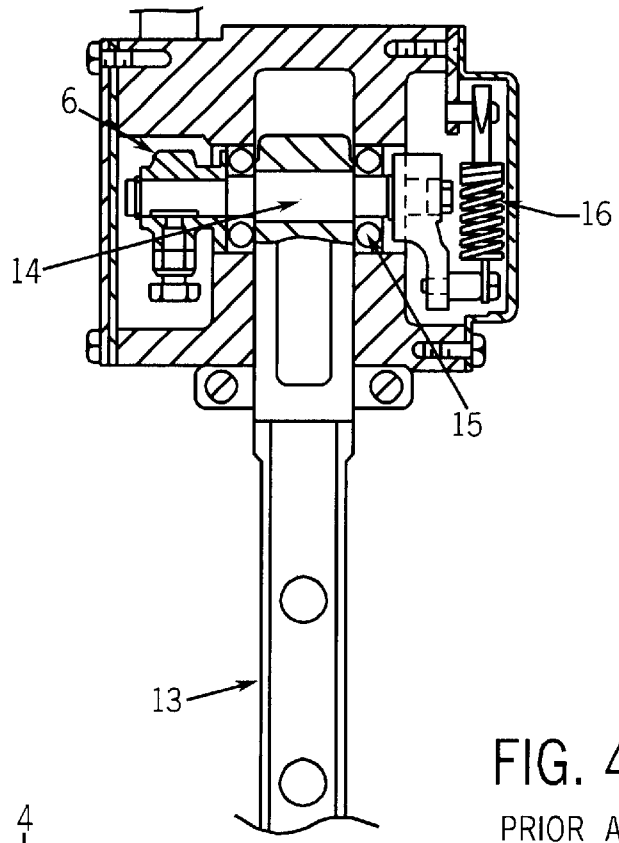
FIG. 4C PRIOR ART
FIG. 4C shows a front view of a double bleedoff auto palm guide of the prior art.
Figure 4D:
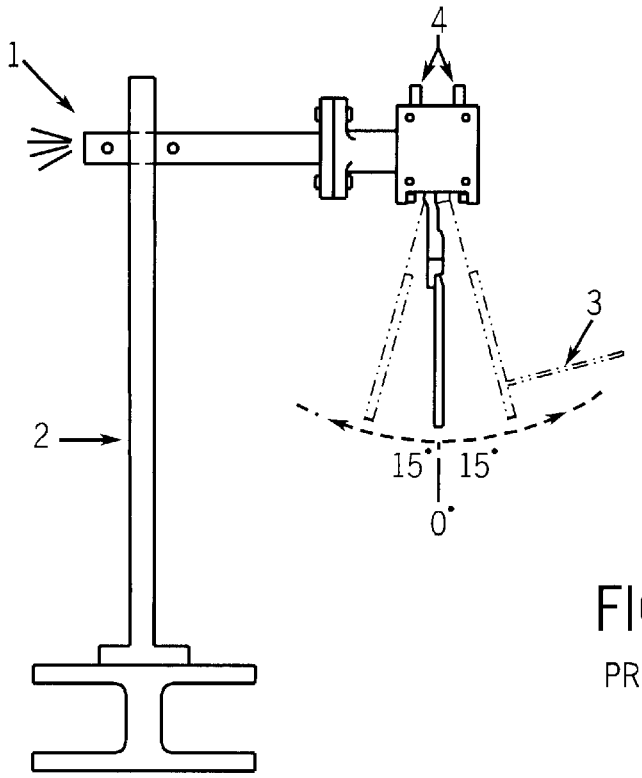
FIG. 4D PRIOR ART
FIG. 4D shows the operation of a cross-sectional view of a double bleedoff auto palm guide of the prior art.

The radial air switch and palm guide of the present invention is a device for sensing and correcting the position of the paper machine's fabric or felt. The palm guide is used in conjunction with the paper machine's fabric or felt guide rolls. The purpose of the auto palm guide and guide roll (operating together) is to keep the paper machine fabric or felt centered on the operating machine. See FIG. 2.

The air switch and palm guide of the present invention adjusts the air pressure in the guide diaphragm, or the balance of air pressure in the positioning cylinder. As the fabric moves off center, the movement of the palm guide directly varies the cam rotation exposing the appropriate inlet port side opening to the cam chamber which in turn controls the air pressure bleedoff rate.

The unique configuration of the palm arm and the weight of the palm itself keeps the palm guide in contact with the edge of the fabric or felt. When the fabric or felt shifts, the palm guide follows, causing the appropriate inlet port side entry to open or close to the cam chamber.

The correct operating scenario is shown in FIGS. 9A–9C. In the neutral position shown in FIG. 9A, the fabric is centered on the guide roll and the palm guide is in a vertical position, in contact with the fabric or felt. The unique configuration of the palm arm and the clamping arrangement to the camshaft of the present invention allows the maintenance technician to adjust the palm arm position to any degree of rotation for the cam. For example, in a twin bleedoff guiding arrangements, the palm arm can be set at vertical with the cam clamped at the center of rotation and both inlet ports closed. Also for example, for a single bleedoff guiding arrangement, a palm arm can be set at vertical with the radial cam clamped at 5 degrees from center resulting in 15 lbs. of 30 lbs. air pressure bleeding off.

Figure 5A:
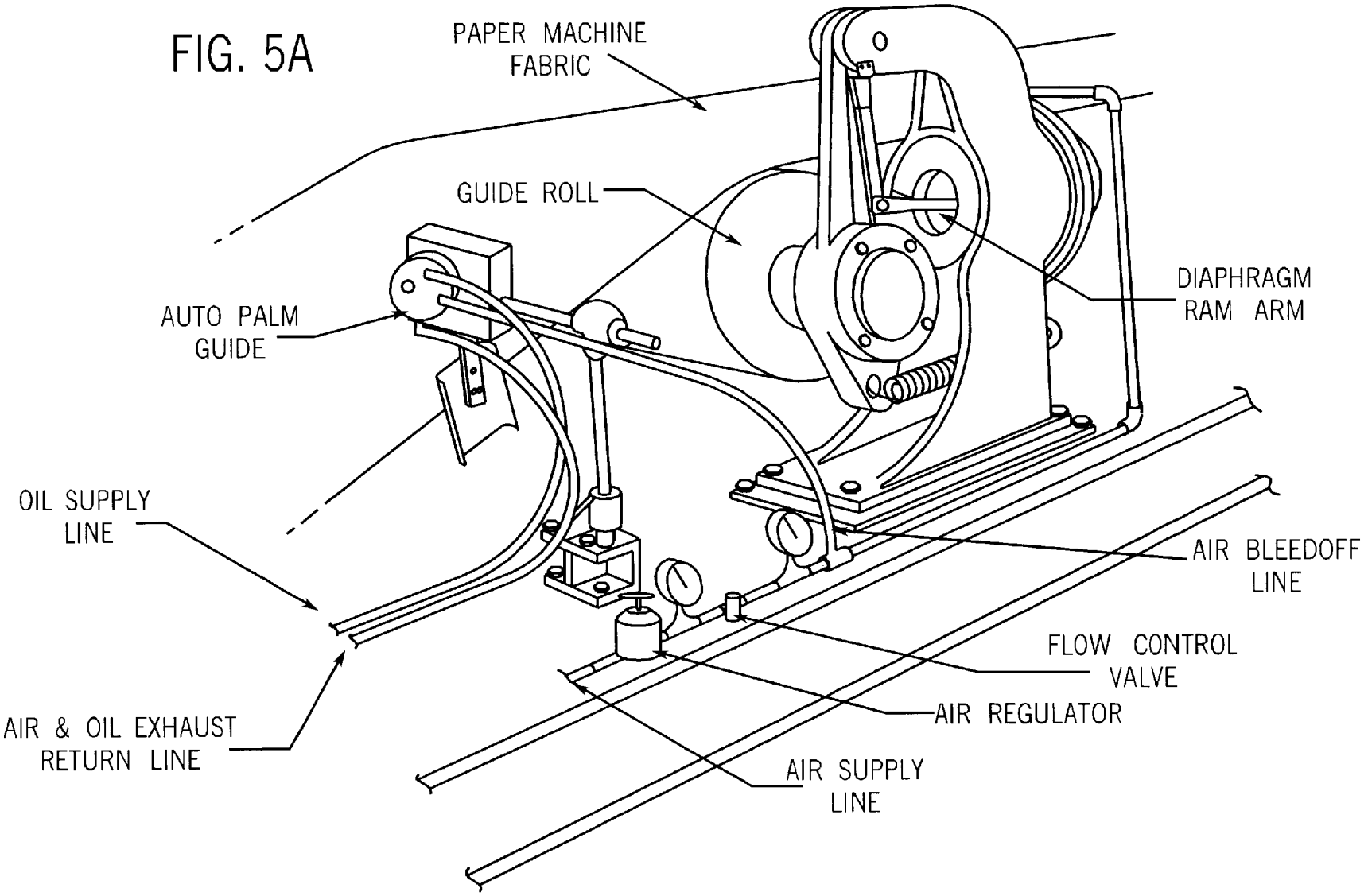
FIG. 5A shows a perspective view of the radial air switch and palm guide of the invention that is retro-fit into a typical single bleedoff felt guide.
Figures 5B, 11:
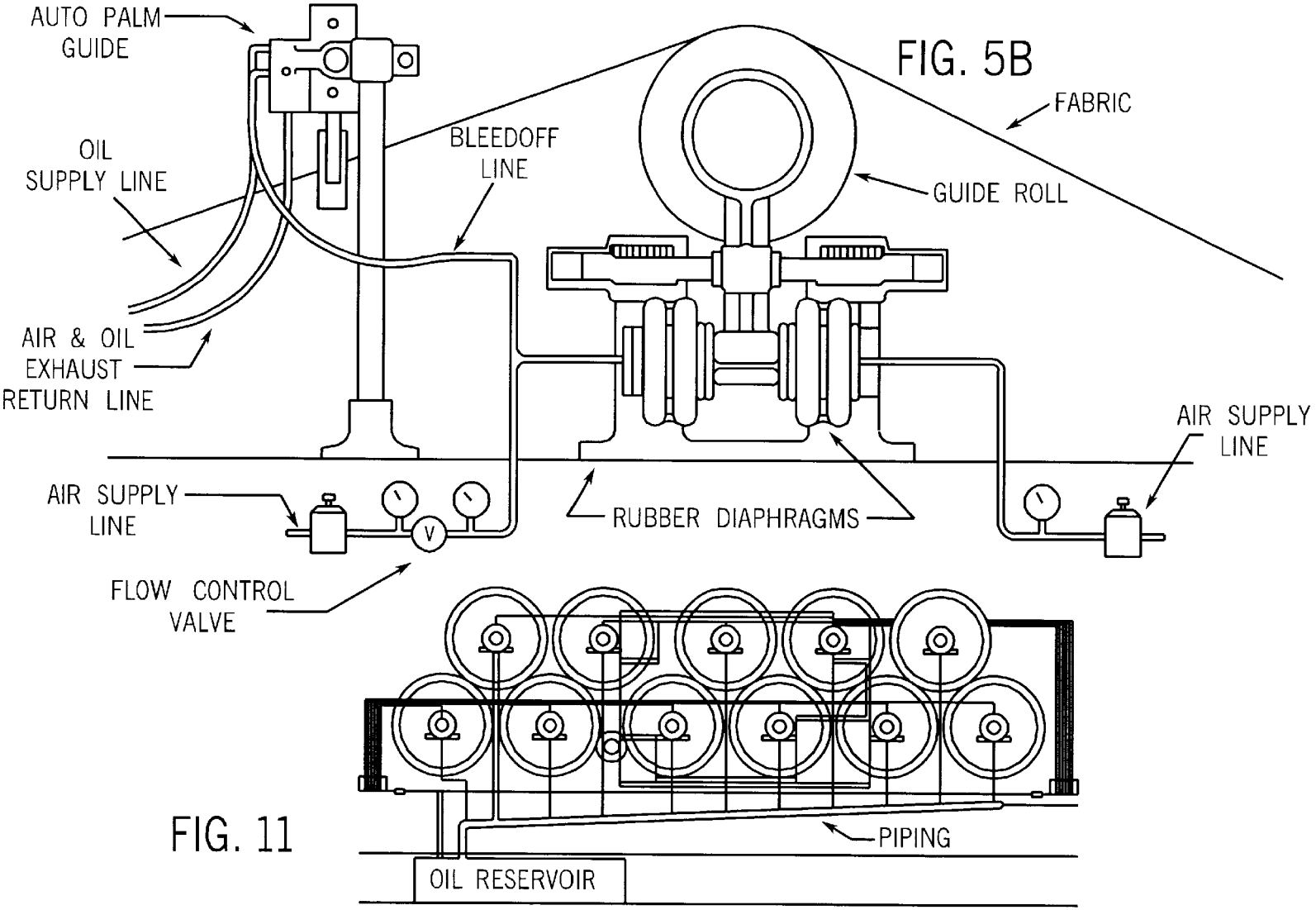
FIG. 5B shows a side view of the radial air switch and palm guide of the invention that is retro-fit into a typical single bleedoff wire guide.
FIG. 11 shows a schematic of a typical dryer section and typical oil lubrication piping lines.

A single bleedoff line type guiding arrangement with a single or twin diaphragm is shown in FIGS. 5A and 5B.

When the wire or fabric is centered on the guide roll, the palm guide is in a vertical position, contacting the fabric. The guide roll swing arm should be at the center of its travel, at which time the air switch of the palm guide should be bleeding off about one half of the preset air pressure limit. This means the air bleed rate controls the guide roll steering. When used in this type arrangement, the air switch and palm guide is using only one of its inlet ports, and the other is plugged.

The diaphragm operated pneumatic guide shown in FIG. 5A works on the principle of a variable air pressure in the diaphragm chamber against the resistance of the tension return spring. This guide uses a bleedoff type air switch operated by a contact palm running against the felt or fabric edge. With the felt or fabric in the desired running position, the pressure in the diaphragm chamber equals the spring resistance holding the guide roll in place. When a deviation occurs in the palm position due to movement of the felt, the air switch bleedoff is changed causing a variable pressure in the diaphragm chamber. If the pressure in the diaphragm chamber is lessened, the pull of the spring moves the guide roll. If the pressure is increased, then the air pressure overcomes the spring resistance, moving the guide roll in the opposite direction.

Figure 6A:
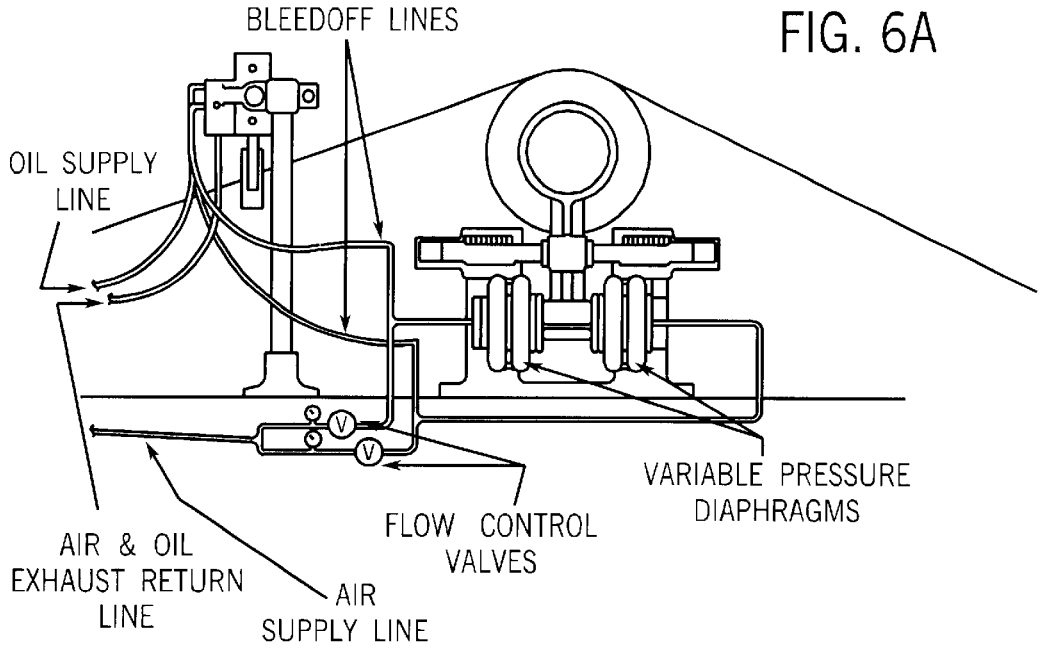
FIG. 6A shows a side view of the radial air switch and palm guide of the invention that is retro-fit into a typical double bleedoff wire guide.
Figure 6B:
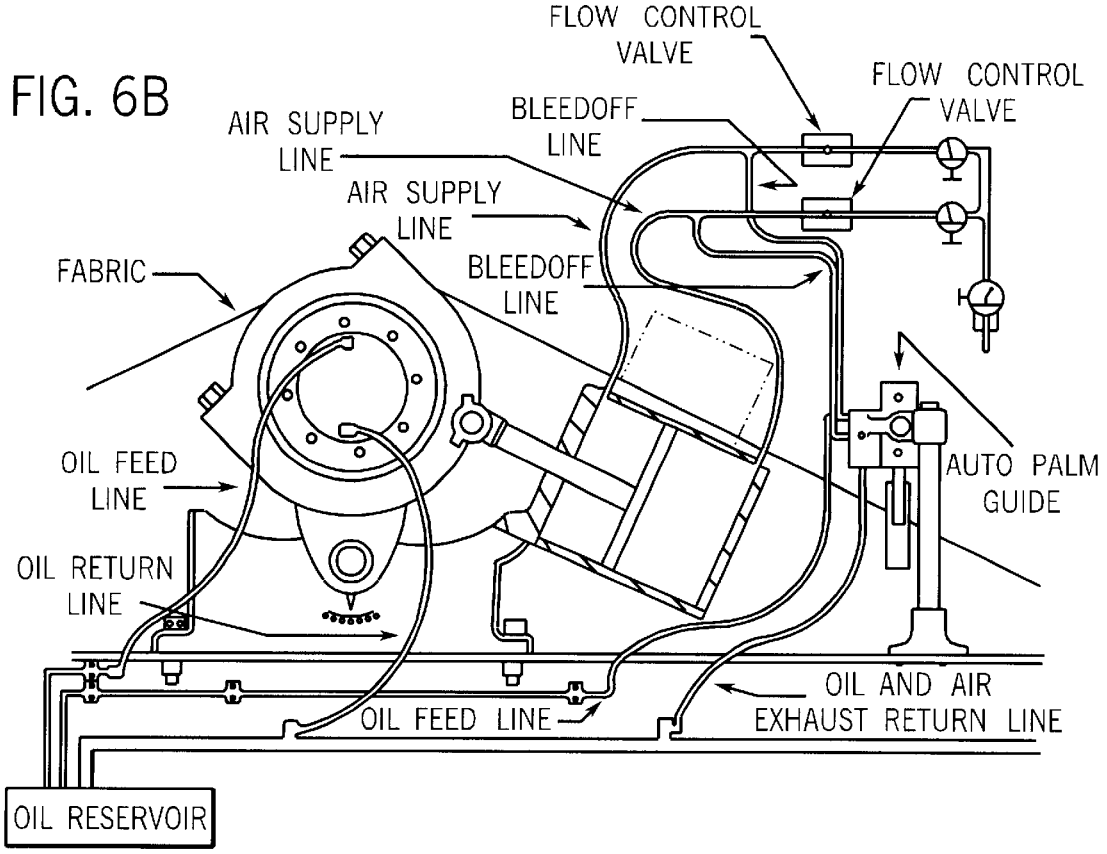
FIG. 6B shows a view of the radial air switch and palm guide of the invention that is retro-fit into a typical double bleedoff positioning cylinder felt guide.
Figure 8A:
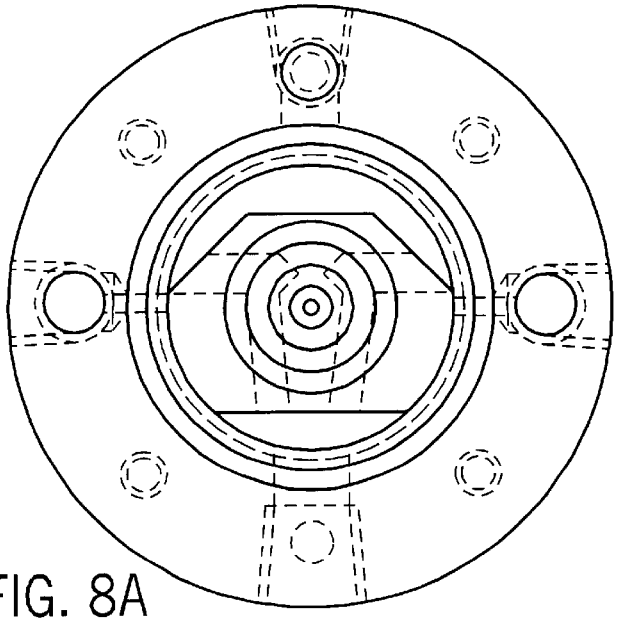
FIG. 8A shows the new cam installed in the radial air switch cylinder at 0 degrees.
Figure 8B:
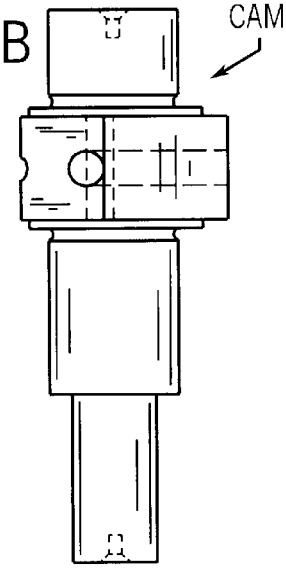
FIG. 8B shows a side view of the cam and shaft.
Figure 8D:
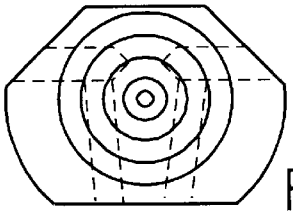
FIG. 8D shows an end of the cam and shaft.
Figure 8C:
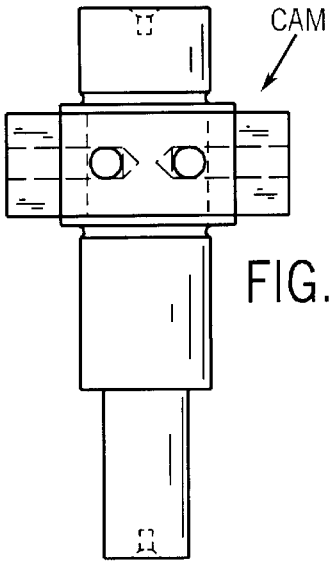
FIG. 8C shows a bottom view of the cam and shaft.
Figure 8E:
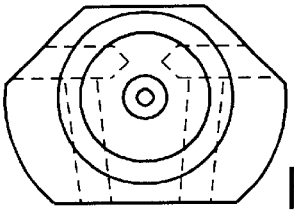
FIG. 8E shows an end view from the opposite end of the cam and shaft.
Figure 8F:
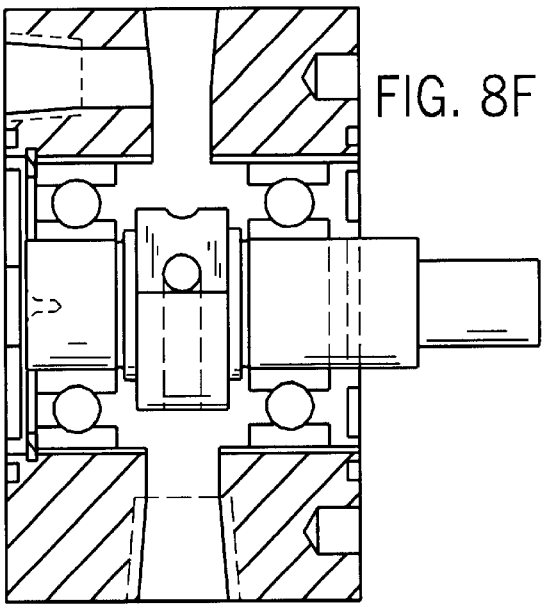
FIG. 8F shows a side cutaway view of the cam and shaft in an air switch housing with bearings.
Figure 9E:
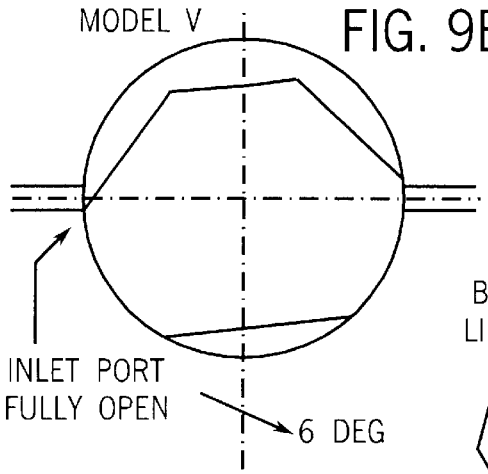
FIGS. 9E–G show various cam configurations and rotational parameters for different timing and operations.
Figure 9F:
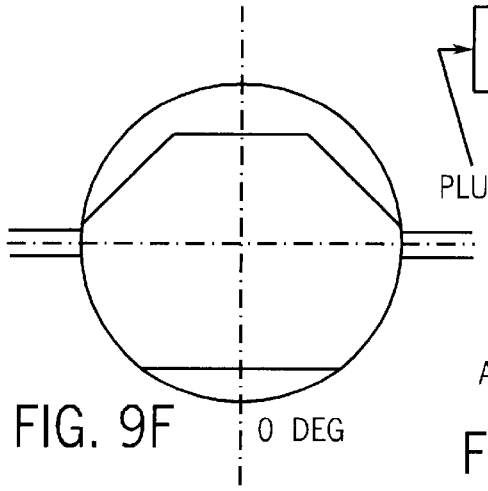
Figure 9D:
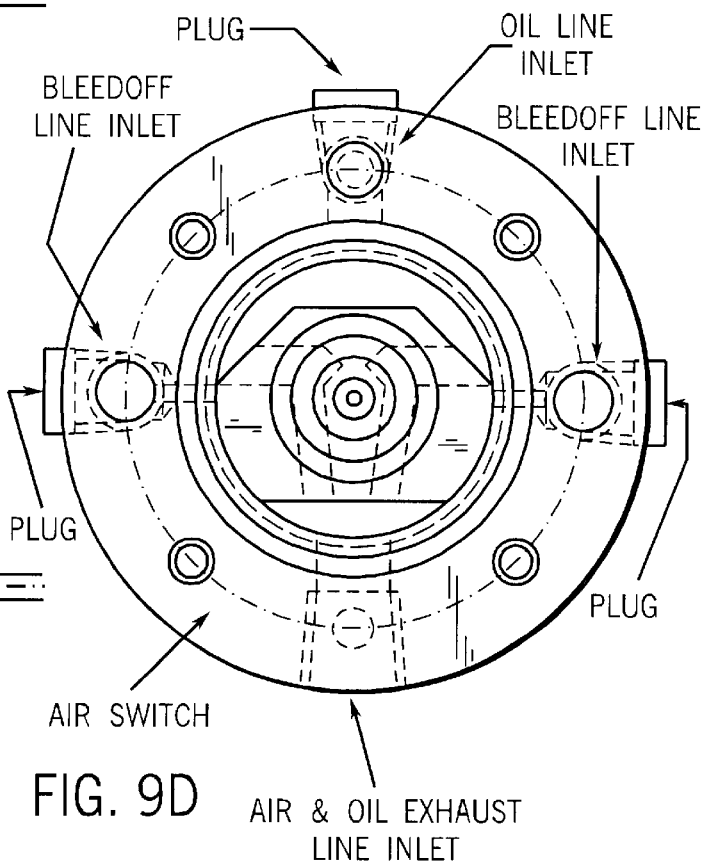
FIG. 9D shows the radial cam in the enclosed cylinder and indicates the various inlet and outlet ports.
Figure 9G:
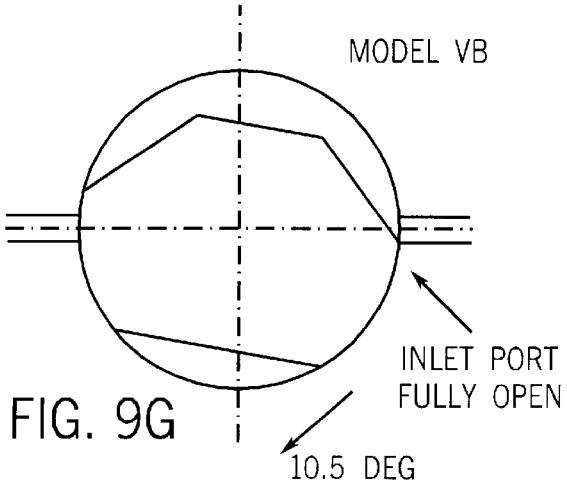

For a twin bleedoff diaphragm and/or positioning cylinder type guiding arrangements shown in FIGS. 6A and 6B, the auto palm guide utilizes both A and B side inlet ports. The fabric is centered on the guide roll and the palm is in a vertical position, contacting the fabric. When the radial cam is at center, both inlet ports are closed, and both pressures are constant and even. The radial cam design and rubber palm arm stops insure both inlet ports are never open at the same time. Movement of the palm arm of more than one and a half degrees from center will start to open one of the inlet port holes to the cam chamber and pressure on that open port side will decrease. The guide roll will actuate toward the side with less pressure. When correction occurs, the palm comes back to center. The felt is now centered. The cam is also again centered with both ports closed. The result is that the pressure is then equalized on both sides, and guide roll moves to center.

A guiding arrangement can overreact or react too quickly and cause oversteering of the guide roll, resulting in excessive oscillation. Therefore, most guiding arrangements employ the assistance of air flow control. The air flow control valve (see FIGS. 5A, 5B, 6A and 6B) allows the auto palm guide to bleedoff air pressure, and slows the air pressure recovery rate. The flow control valve allows a maintenance technician the ability to adjust the reaction time of the guide roll in order to reduce oscillation of the fabric.

The radial cam chamber of the present invention is an unpressurized area. As shown for example in FIGS. 8A and 9A–C, the cam has two passages drilled parallel to, but slightly above the level of air inlet ports. These passages enter into the angled flats near the top of the cam ending near the center of the cam, and are intersected by two holes drilled from the bottom flat of the cam angled toward the exhaust outlet. These two passages facilitate two escape routes for the rush of air that enters the cam chamber when the cam rotates to open one of the two air inlet ports.

Lubrication Operation

As the cam rotates to open one of the two air inlet ports, the very top of the cam is flat and tilts to direct the incoming oil flow toward the incoming air flow. As the rushing air enters one of the cam's two escape passages, a mild vacuum effect in the cam chamber's upper half occurs. The turbulence of rushing air and oil combine to create atomization of some of the incoming oil. As a result of the normal operation of the new air switch and palm guide, the bearings and cam are cooled, sprayed, splashed, and fogged with air and oil continuously. Furthermore the unique integrated lubrication system virtually eliminates heat and moisture as critical factors, giving this new air switch and palm guide extraordinary service longevity.

Essentially all internal moving parts of the air switch and palm guide are lubricated with a clean filtered fresh constant flow of oil from the paper machine's oil bank. All oil and air used by the air switch and palm guide is injected into the paper machine oil return line from the air switch air and oil exhaust line. See FIG. 11.

The used oil then flows to the paper machine reserve tank. The used air escapes via the oil return line breather caps placed at various locations on the paper machine as original equipment. The air switch lubrication area is sealed by two O rings located on the sides of the air switch and also by a single lip seal located at the palm arm end of the cam shaft. The oil flows through the oil inlet port into the cam chamber splashing over the cam and bearings down through the two bearing shoulder spacings and out the exhaust port.

High Temp Edge Preserver

Palms guides are typically made of stainless steel. The constant contact of the moving fabric or felt causes the palm to wear. So most palms are flame sprayed with a ceramic coating. One flame sprayed palm can last for many years. Wires and wet press felts have enough water content to lubricate the palm, but the dryer fabrics do not.

Stainless doesn't dissipate heat very well and even polished ceramic is an abrasive surface. 300 degree heat plus friction will cause palms on high speed paper machines to get so hot they wear and melt the sealed edge of even special high temp dryer fabrics. Uneven, erratic wear on the dryer fabric sealed edge is sometimes referred to as scalping and is an extremely common problem, especially on big, high temperature, high speed paper machines.

The edge of the dryer fabric will become progressively worse, wearing away more than 1½ in numerous places with some areas of the edge not showing any wear. Scalps on the edge can become 8 to 50 feet in length. This condition also causes the fabric to unweave itself and long strings of monofilament yarns begin to whip at and catch on frame work and the running sheet. When an erratic scalped edge is in contact with the palm guide at 3 to 4 thousand feet per minute, the palm guide as well as the entire guiding arrangement can wear out prematurely. From a palm point of view, a new sealed dryer felt edge can be compared to driving a small boat across a glassy lake at 50 mph, and a scalped edge can be compared to bouncing off three foot roller white cap waves in the same boat at the same speed.

For smoother and safer operation and longer palm guide life, a high temperature palm lubricator is provided for dryer applications. This bolt on high temperature accessory includes two 12" stainless tube lines with mounting plates connecting to an air and water mister. See FIGS. 12A–12D. The function of the edge preserver device is to a provide a lubricating spray of water to the area where the dryer fabric edge and palm make contact.

Having thus described the invention, what is claimed is:

1. An air switch comprising:

a housing having a chamber;

a lubrication port disposed on the housing to deliver lubrication into the chamber;

a first air inlet port disposed on the housing to introduce air into the chamber;

a second air inlet port disposed on the housing to introduce air into the chamber;

an exhaust port disposed on the housing to exhaust lubrication and air from the chamber; and a cam rotatably mounted in the chamber, wherein the cam is rotatable to a first position wherein the first and second air inlet ports are closed when the cam is in the first position and the lubrication port is in fluid communication with the exhaust port such that lubrication can flow from the lubrication port to the exhaust port when the cam is in the first position.

2. The air switch of claim 1 wherein the cam is rotatable to a second position wherein the first air inlet port is closed when the cam is in the second position, the second air inlet port is open thereby allowing air to flow from the second air inlet port to the exhaust port when the cam is in the second position, and the lubrication port is in fluid communication with the exhaust port such that lubrication can flow from the lubrication port to the exhaust port when the cam is in the second position.

3. The air switch of claim 2 wherein the cam is rotatable to a third position wherein the second air inlet port is closed when the cam is in the third position, the first air inlet port is open thereby allowing air to flow from the first air inlet port to the exhaust port when the cam is in the third position, and the lubrication port is in fluid communication with the exhaust port such that lubrication can flow from the lubrication port to the exhaust port when the cam is in the third position.

4. The air switch of claim 3 wherein the exhaust port is larger that the lubrication port.

5. The air switch of claim 3 wherein the chamber is unpressurized during normal operation of the air switch.

6. The air switch of claim 3 wherein the air switch is configured to allow for a constant flow of lubrication from the lubrication port to the exhaust port with the cam in the first position, the second position and the third position.

7. The air switch of claim 3 wherein the cam is rotatably mounted inside of the chamber on a pair of unsealed bearings disposed such that each of the pair of bearings is lubricated by the lubrication delivered to the chamber from the lubrication port.

8. The air switch of claim 3 wherein the cam further includes a top disposed to direct the flow of lubrication from the lubrication port to the first air inlet port when the first air inlet port is open and to the second air inlet port when the second air inlet port is open.

9. The air switch of claim 3 wherein the cam further includes a first air escape passage disposed to direct the flow of air from the first air inlet port to the exhaust port when the first air inlet port is open and a second air escape passage disposed to direct the flow of air from the second air inlet port to the exhaust port when the second air inlet port is open.

10. The air switch of claim 3 further including a source of lubrication connected to the lubrication port.

11. The air switch of claim 10 further including a tank connected to the exhaust port and disposed to hold exhausted lubrication.

12. The air switch of claim 1 wherein the first air inlet port is opened by rotating the cam from the first position to a second position thereby allowing air to flow from the first air inlet port to the exhaust port and the second air inlet port is opened by rotating the cam from the first position to a third position thereby allowing air to flow from the second air inlet port to the exhaust port.

13. The air switch of claim 12 wherein the second air inlet port remains closed during rotation of the cam between the first position and the second position and the first air inlet port remains closed during rotation of the cam between the first position and the third position.

14. The air switch of claim 12 wherein the lubrication port is in fluid communication with the exhaust port during rotation of the cam between the first position and the second position and during rotation of the cam between the first position and the third position such that lubrication can flow from the lubrication port to the exhaust port.

15. An air switch comprising:

a housing having a chamber;

a lubrication port disposed on the housing to deliver lubrication into the chamber;

a first air inlet port disposed on the housing to introduce air into the chamber;

an exhaust port disposed on the housing to exhaust lubrication and air from the chamber;

wherein the lubrication port is in fluid communication with the exhaust port such that lubrication can flow from the lubrication port to the exhaust port when the first air inlet port is open and when the first air inlet port is closed.

16. The air switch of claim 15 wherein the exhaust port is larger that the lubrication port.

17. The air switch of claimed wherein the chamber is unpressurized during normal operation of the air switch.

18. The air switch of claim 15 wherein the air switch is configured to allow for a constant flow of lubrication from the lubrication port to the exhaust port when the first air inlet port is open and when the first air inlet port is closed.

19. The air switch of claim 15 further including a cam rotatably mounted in the chamber wherein rotation of the cam opens and closes the first air inlet port to the chamber.

20. The air switch of claim 19 wherein the cam is rotatably mounted inside of the chamber on a pair of unsealed bearings disposed such that each of the pair of bearings is lubricated by the lubrication delivered to the chamber from the lubrication port.

21. The air switch of claim 19 wherein the cam further includes a top disposed to direct the flow of lubrication from the lubrication port to the first air inlet port when the first air inlet port is open.

22. The air switch of claim 19 wherein the cam further includes a first air escape passage disposed to direct the flow of air from the first air inlet port to the exhaust port when the first air inlet port is open.

23. The air switch of claim 15 further comprising a source of lubrication connected to the lubrication port.

24. The air switch of claim 23 further including a tank connected to the exhaust port and disposed to hold exhausted lubrication.

25. The air switch of claim 15 further including a second air inlet port disposed to introduce air into the chamber wherein one of the first or second air inlet ports is selectively opened thereby allowing air to flow from the open air inlet port to the exhaust port while the other of the first or second air inlet ports remains closed.

26. The air switch of claim 25 wherein the lubrication port is in fluid communication with the exhaust port when both the first and second air inlet ports are closed such that lubrication can flow from the lubrication port to the exhaust port.

27. The air switch of claim 26 wherein the lubrication port is in fluid communication with the exhaust port when a selective one of the first or second air inlet ports is open such that lubrication can flow from the lubrication port to the exhaust port.

28. An air switch lubrication system comprising;

a chamber;

a lubrication port disposed to deliver a lubricant into the chamber;

a first air inlet port disposed to introduce pressurized air into the chamber;

an exhaust port for exhausting the lubricant and air from the chamber;

wherein the air switch lubrication system is configured such that the introduction of pressurized air into the chamber from the first air inlet port circulates the lubricant introduced into the chamber from the lubrication port throughout the chamber.

29. The air switch lubrication system of claim 28 further including a second air inlet port disposed to introduce pressurized air into the chamber wherein the introduction of pressurized air into the chamber from a selective one of the first or second air inlet ports circulates the lubricant introduced into the chamber from the lubrication port throughout the chamber.

30. The air switch lubrication system of claim 29 wherein the lubrication port is in fluid communication with the exhaust port when the first air inlet port is open and when the second air inlet port is open such that the lubricant delivered to the chamber from the lubrication port can flow from the lubrication port to the exhaust port.

31. The air switch lubrication system of claim 30 wherein the lubrication port is in fluid communication with the exhaust port when both the first and second air inlet ports are closed such that the lubricant delivered to the chamber from the lubrication port can flow from the lubrication port to the exhaust port.

32. The air switch lubrication system of claim 29 further including a cam rotatably mounted in the chamber wherein rotation of the cam selectively opens one of the first or second air inlet ports.

33. The air switch lubrication system of claim 32 wherein the cam further includes a top disposed to direct the flow of lubrication from the lubrication port to the open air inlet port.

34. The air switch lubrication system of claim 32 wherein the cam further includes a pair of air escape passages disposed to direct the flow of air from the open air inlet port to the exhaust port.

* * * * *